US011713657B2

(12) United States Patent
Tusing

(10) Patent No.: US 11,713,657 B2
(45) Date of Patent: Aug. 1, 2023

(54) DISTRIBUTED CONTROL SYSTEM FOR A WELL STRING

(71) Applicant: OneSubsea IP UK Limited, London (GB)

(72) Inventor: Adam Tusing, Houston, TX (US)

(73) Assignee: OneSubsea IP UK Limited, Londong (GB)

( * ) Notice: Subject to any disclaimer, the term of this patent is extended or adjusted under 35 U.S.C. 154(b) by 0 days.

(21) Appl. No.: 17/355,348

(22) Filed: Jun. 23, 2021

(65) Prior Publication Data

US 2021/0396107 A1 Dec. 23, 2021

Related U.S. Application Data

(60) Provisional application No. 63/042,593, filed on Jun. 23, 2020.

(51) Int. Cl.

| | |
|---|---|
| ***E21B 34/06*** | (2006.01) |
| ***E21B 34/10*** | (2006.01) |
| ***E21B 43/12*** | (2006.01) |

(52) U.S. Cl.
CPC ..... *E21B 43/12* (2013.01); *E21B 34/066* (2013.01); *E21B 34/10* (2013.01)

(58) Field of Classification Search
CPC ..... E21B 34/066; E21B 34/10; E21B 34/16; E21B 41/00; E21B 43/12
See application file for complete search history.

(56) References Cited

U.S. PATENT DOCUMENTS

| | | | | |
|---|---|---|---|---|
| 8,451,137 | B2 * | 5/2013 | Bonavides | E21B 47/12 340/853.3 |
| 10,429,162 | B2 * | 10/2019 | Papillon | F42D 1/055 |
| 2005/0045331 | A1 * | 3/2005 | Lerche | E21B 43/11857 166/55 |

(Continued)

FOREIGN PATENT DOCUMENTS

| | | | | |
|---|---|---|---|---|
| CN | 112696172 | A | 4/2021 | |
| EP | 2172618 | A2 | 4/2010 | |
| GB | 2598031 | A * | 2/2022 | E21B 33/0355 |

OTHER PUBLICATIONS

Combined Search and Exam Report under Sections 17 & 18(3) issued in Application No. GB2109005.5 dated Dec. 10, 2021, 6 pages.

(Continued)

*Primary Examiner* — Daniel P Stephenson
(74) *Attorney, Agent, or Firm* — Eileen Pape

(57) ABSTRACT

A distributed control system for a well string includes a first control section configured to be positioned at a first location. The first control section includes a first control module configured to control a first device positioned at the first location, and the first control module includes a first electric actuator configured to control flow of a fluid to the first device based on a first control signal to control the first device. The distributed control system also includes a second control section configured to be positioned at a second location, remote from the first location. The second control section includes a second control module configured to control a second device positioned at the second location, and the second control module includes a second electric actuator configured to control flow of the fluid to the second device based on the second control signal to control the second device.

17 Claims, 3 Drawing Sheets

(56) References Cited

U.S. PATENT DOCUMENTS

| | | | | |
|---|---|---|---|---|
| 2005/0046592 | A1* | 3/2005 | Cooper | G01V 11/002 340/855.7 |
| 2007/0096941 | A1* | 5/2007 | Morys | G01V 11/002 340/853.1 |
| 2007/0152054 | A1* | 7/2007 | Bonavides | G01N 29/06 235/454 |
| 2010/0085210 | A1* | 4/2010 | Bonavides | E21B 43/11 340/853.2 |
| 2013/0010572 | A1* | 1/2013 | Bonavides | E21B 43/11 367/81 |
| 2013/0168101 | A1* | 7/2013 | Bryson | E21B 34/04 166/341 |
| 2015/0240585 | A1* | 8/2015 | Mancuso | E21B 33/064 166/338 |
| 2017/0145773 | A1* | 5/2017 | van Wijk | F15B 1/02 |
| 2017/0331280 | A1* | 11/2017 | Koenecke | E21B 47/00 |
| 2020/0399981 | A1* | 12/2020 | Tusing | E21B 33/0355 |
| 2021/0396107 | A1* | 12/2021 | Tusing | E21B 34/066 |

OTHER PUBLICATIONS

Exam Report issued in United Kingdom Patent Application No. GB2109005.5 dated Aug. 30, 2022, 4 pages.
Exam Report issued in United Kingdom Patent Application No. GB2109005.5 dated Dec. 16, 2022, 3 pages.

* cited by examiner

DISTRIBUTED CONTROL SYSTEM FOR A WELL STRING

BACKGROUND

This application claims priority from and the benefit of U.S. Provisional Application Ser. No. 63/042,593 entitled "DISTRIBUTED MODULAR LANDING STRING CONTROL SYSTEM," filed Jun. 23, 2020, which is hereby incorporated by reference in its entirety.

BACKGROUND

The present disclosure relates generally to a distributed control system for a well string.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Fluids (e.g., hydrocarbons) may be extracted from subsurface reservoirs and transported to the surface for commercial sale, such as for use in the power industry, transportation industry, manufacturing industry, and other applicable industries. For example, a well may be drilled into the ground to a subsurface reservoir, and equipment may be installed in the well and on the surface to facilitate extraction of the fluids. In some cases, the wells may be offshore (e.g., subsea), and the equipment may be disposed underwater, on offshore platforms, and/or on floating systems.

Mineral extraction systems may include a landing string (e.g., tubing string) that extends through a wellbore of the well from a wellhead system to the subsurface reservoir. The landing string generally includes multiple devices (e.g., valve(s), locking mechanism(s), actuator(s), etc.) that may be controlled during the landing string running process and/or during operation of the mineral extraction system. In certain mineral extraction system configurations, a control system having multiple control modules is positioned above a blowout preventer (BOP) of the wellhead system. Each control module is configured to control a respective device (e.g., valve, locking mechanism, etc.) of the landing string by controlling flow of hydraulic fluid from the control system, which is positioned above the BOP, to the respective device positioned along a length of the landing string. Unfortunately, due to the separation distances between the control modules and the respective devices, the response time associated with controlling certain devices may be slower than desired. In addition, to accommodate a variety of landing string configurations, the control system may include a large number of control modules. Accordingly, for landing strings that include a smaller number of devices, the control system may include extraneous control modules, thereby undesirably increasing the cost of the mineral extraction system.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain embodiments, a distributed control system for a well string (e.g., landing string) includes a first control section configured to be positioned at a first location along a length of the well string. The first control section includes a first control module configured to control a first device positioned at the first location along the length of the well string, the first control module includes a first electric actuator configured to receive a first control signal, and the first electric actuator is configured to control flow of a fluid to the first device based on the first control signal to control the first device. The distributed control system also includes a second control section configured to be positioned at a second location along the length of the well string, remote from the first location. The second control section includes a second control module configured to control a second device positioned at the second location along the length of the well string, the second control module includes a second electric actuator configured to receive a second control signal, and the second electric actuator is configured to control flow of the fluid to the second device based on the second control signal to control the second device.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
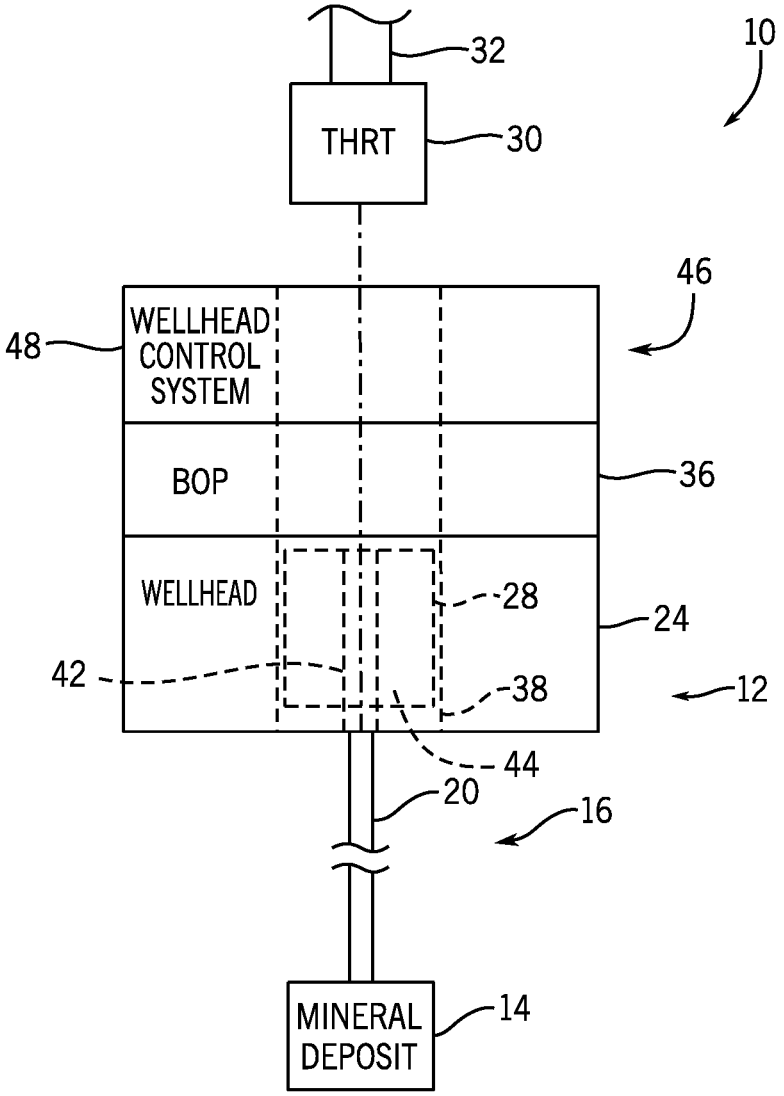
FIG. 1 is a block diagram of an embodiment of a mineral extraction system.

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

As explained above, a mineral extraction system may include a control system having multiple control modules, and the control system may be positioned above a blowout preventer (BOP) of the wellhead system. The control modules may control flow of hydraulic fluid from the control system to respective devices positioned along a length of a landing string, thereby controlling operation of the respective devices. Unfortunately, due to the separation distances between the control modules and the respective devices, the response time associated with controlling certain devices may be slower than desired. In addition, to accommodate a variety of landing string configurations, the control system may include a large number of control modules. Accordingly, for landing strings that include a smaller number of devices, the control system may include extraneous control modules, thereby undesirably increasing the cost of the mineral extraction system.

In certain embodiments disclosed herein, the mineral extraction system may include a distributed control system having multiple control sections distributed along a length of a landing string. A first control section is configured to be positioned at a first location along the length of the landing string. The first control section includes a first control module configured to control a first device positioned at the first location along the length of the landing string, the first control module includes a first electric actuator configured to receive a first control signal, and the first electric actuator is configured to control flow of a fluid to the first device based on the first control signal to control the first device. A second control section is configured to be positioned at a second location along the length of the landing string, remote from the first location. The second control section includes a second control module configured to control a second device positioned at the second location along the length of the landing string, the second control module includes a second electric actuator configured to receive a second control signal, and the second electric actuator is configured to control flow of the fluid to the second device based on the second control signal to control the second device. Because the control modules are positioned at the same location along the length of the landing string as the respective devices, the response time associated with controlling the devices may be substantially reduced (e.g., as compared to a control system having control modules positioned above a BOP of the mineral extraction system). Furthermore, in certain embodiments, a control module may be included for each respective device of the landing string. Accordingly, the distributed control system may not include any extraneous control modules, thereby decreasing the cost of the mineral extraction system (e.g., as compared to a mineral extraction system having a control system configured to accommodate landing string configurations having a larger number of devices).

FIG. 1 is a block diagram of an embodiment of a mineral extraction system 10. The mineral extraction system 10 may be configured to extract various minerals and natural resources, including hydrocarbons (e.g., oil and/or natural gas) from the earth, and/or the mineral extraction system may be configured to inject substances into the earth. In some embodiments, the mineral extraction system 10 is land-based (e.g., a surface system) or subsea (e.g., a subsea system). As illustrated, the mineral extraction system 10 includes a wellhead system 12 coupled to a mineral deposit 14 via a well 16 having a wellbore 20.

In the illustrated embodiment, the wellhead system 12 includes a wellhead 24 and a tubing hanger 28 disposed within the wellhead 24. The mineral extraction system 10 may include other device(s) that are coupled to the wellhead system 12 and/or device(s) that are used to assemble various components of the wellhead system 12. For example, in the illustrated embodiment, the mineral extraction system 10 includes a tubing hanger running tool (THRT) 30 suspended from a drilling string 32. In certain embodiments, the tubing hanger 28 supports tubing (e.g., a tubing/landing string). During a running or lowering process, the THRT 30 is coupled to the tubing hanger 28, thereby coupling the tubing hanger 28 to the drilling string 32. The THRT 30, which is coupled to the tubing hanger 28, is lowered (e.g., run) from an offshore vessel to the wellhead 24. Once the tubing hanger 28 has been lowered into a landed position within the wellhead 24, the tubing hanger 28 may be permanently locked into position. The THRT 30 may then be uncoupled from the tubing hanger 28 and extracted from the wellhead system 12 by the drilling string 32, as illustrated.

In the illustrated embodiment, the wellhead system 12 includes a blowout preventer (BOP) 36. The BOP 36 may include a variety of valves, fittings, and controls to block oil, gas, or other fluid from exiting the well in the event of an unintentional release of pressure or an overpressure condition. Furthermore, the wellhead 24 has a bore 38, which may provide access to the wellbore 20 for various completion and workover procedures. For example, components may be run down to the wellhead system 12 and disposed in the wellhead bore 38 to seal-off the wellbore 20, to inject chemicals down-hole, to suspend tools down-hole, to retrieve tools, and the like.

The wellbore 20 may contain elevated fluid pressures. For example, pressures within the wellbore 20 may exceed 10,000 pounds per square inch (PSI), 15,000 PSI, or 20,000 PSI. Accordingly, the mineral extraction system 10 may employ various mechanisms, such as mandrels, seals, plugs, and valves, to control the well 16. For example, the illustrated tubing hanger 28 may be disposed within the wellhead 24 to secure tubing suspended in the wellbore 20, and to provide a path for hydraulic control fluid, chemical injection, electrical connection(s), fiber optic connection(s), and the like. The tubing hanger 28 includes a central bore 42 that extends through the center of a body 44 of the tubing hanger 28, and the central bore 42 is in fluid communication with the wellbore 20. The central bore 42 is configured to facilitate flow of hydrocarbons through the body 44 of the tubing hanger 28.

In the illustrated embodiment, the mineral extraction system 10 includes a distributed control system 46 configured to control multiple devices (e.g., valve(s), locking mechanism(s), actuator(s), etc.) of a landing string 50 (shown in FIG. 2) (e.g., during the landing string running process, during operation of the mineral extraction system 10, etc.). The distributed control system 46 includes a wellhead control system 48 positioned above the BOP 36 and having a wellhead electronic controller. As discussed in detail below, the wellhead electronic controller is configured to output one or more device control signals to control the devices of the landing string. Furthermore, in certain embodiments, the wellhead control system may include an electrical power system and/or a fluid power unit. As discussed in detail below, the distributed control system 46 also includes multiple control sections distributed along a length of the landing string, including a first control section and a second control section. The first control section may be positioned at a first location along the length of the landing string, and the second control section may be positioned at a second location along the length of the landing string. The first control section includes a first control module configured to control a first device positioned at the first location, the first control module includes a first electric actuator configured to receive a first control signal, and the first electric actuator is configured to control flow of a fluid to the first device based on the first control signal to control the first device. For example, the first control signal may be received from a first control section electronic controller, which is configured to receive the one or more device control signals from the wellhead electronic controller and to output the first control signal based on the one or more device control signals. In addition, the second control section includes a second control module configured to control a second device positioned at the second location, the second control module includes a second electric actuator configured to receive a second control signal, and the second electric actuator is configured to control flow of the fluid to the second device based on the second control signal to control the second device. For example, the second control signal may be received from a second control section electronic controller, which is configured to receive the one or more device control signals from the wellhead electronic controller and to output the second control signal based on the one or more device control signals.

Because the control modules are positioned at the same location along the length of the landing string as the respective devices, the response time associated with controlling the devices may be substantially reduced (e.g., as compared to a control system having control modules positioned above a BOP of the mineral extraction system). Furthermore, in certain embodiments, a control module may be included for each respective device of the landing string. Accordingly, the distributed control system may not include any extraneous control modules, thereby decreasing the cost of the mineral extraction system (e.g., as compared to a mineral extraction system having a control system configured to accommodate landing string configurations having a larger number of devices).

Figure 2:
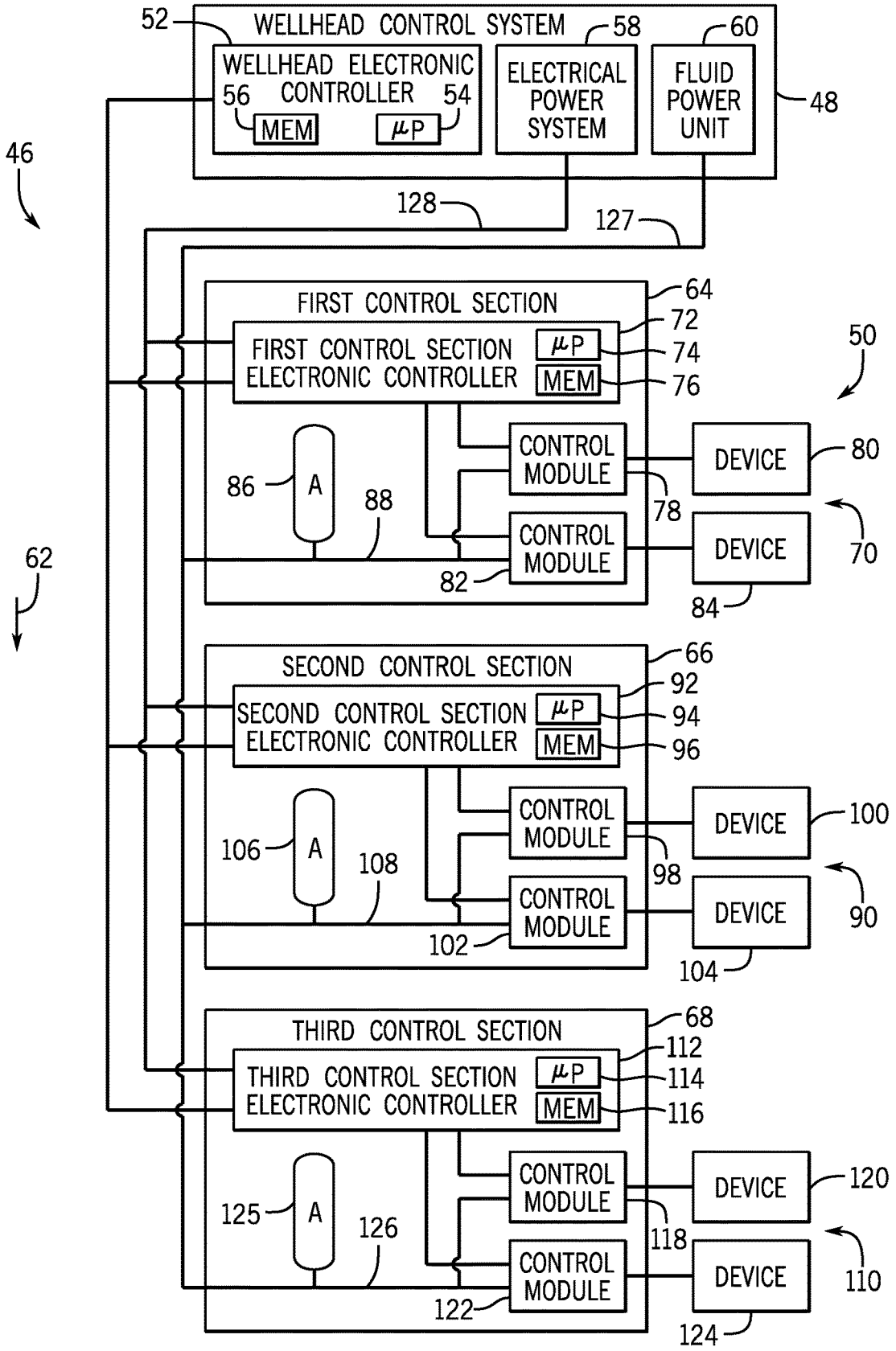
FIG. 2 is a block diagram of an embodiment of a distributed control system that may be employed within the mineral extraction system of FIG. 1.

FIG. 2 is a block diagram of an embodiment of a distributed control system 46 that may be employed within the mineral extraction system of FIG. 1. As previously discussed, the distributed control system 46 is configured to control multiple devices (e.g., valve(s), locking mechanism(s), actuator(s), etc.) of the landing string 50 (e.g., well string). In the illustrated embodiment, the wellhead control system 48 of the distributed control system 46 includes a wellhead electronic controller 52 configured to output one or more device control signals to control the devices of the landing string 50. In certain embodiments, the wellhead electronic controller 52 includes electrical circuitry configured to control the devices of the landing string 50. In the illustrated embodiment, the wellhead electronic controller 52 includes a processor 54, such as a microprocessor, and a memory device 56. The wellhead electronic controller 52 may also include one or more storage devices and/or other suitable component(s). The processor 54 may be used to execute software, such as software for controlling the devices of the landing string 50. Moreover, the processor 54 may include multiple microprocessors, one or more "general-purpose" microprocessors, one or more special-purpose microprocessors, and/or one or more application specific integrated circuits (ASICS), or some combination thereof. For example, the processor 54 may include one or more reduced instruction set (RISC) processors.

The memory device 56 may include a volatile memory, such as random access memory (RAM), and/or a nonvolatile memory, such as read-only memory (ROM). The memory device 56 may store a variety of information and may be used for various purposes. For example, the memory device 56 may store processor-executable instructions (e.g., firmware or software) for the processor 54 to execute, such as instructions for controlling the devices of the landing string 50. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling the devices of the landing string 50, etc.), and any other suitable data.

In the illustrated embodiment, the wellhead control system 48 also includes an electrical power system 58 configured to output electrical power. The electrical power may be used to power various system(s) and/or component(s) of the distributed control system 46, such as control section electronic controllers. The electrical power system 58 may include any suitable device(s)/component(s) configured to generate electrical power (e.g., generator(s), dynamo(s), alternator(s), etc.), to distribute electrical power, to regulate electrical power (e.g., transformer(s), electrical circuitry, etc.), to control flow of electrical power (e.g., switch(es), etc.), or a combination thereof. Furthermore, in certain embodiments, the electrical power system may be omitted, and electrical power may be provided to system(s) and/or component(s) of the distributed control system by another suitable system.

Furthermore, in the illustrated embodiment, the wellhead control system 48 includes a fluid power unit 60 configured to output fluid (e.g., pressurized fluid). In certain embodiments, the fluid may include hydraulic fluid, pneumatic fluid (e.g., air), or a combination thereof. The fluid power unit 60 may be used to provide fluid (e.g., pressurized fluid) to various system(s) and/or component(s) of the distributed control system 46, such as control modules for the landing string devices. The fluid power unit 60 may include one or more pumps, one or more valves, one or more fluid conduits, one or more regulators, other suitable components, or a combination thereof. Furthermore, in certain embodiments, the fluid power unit may be omitted, and fluid (e.g., pressurized fluid) may be provided to system(s) and/or component(s) of the distributed control system by another suitable system.

In certain embodiments, the wellhead control system 48 is positioned above the BOP on the wellhead system. Accordingly, the wellhead control system 48 may be supported by the BOP. However, in other embodiments, the wellhead control system may be positioned remote from the BOP. For example, the wellhead control system may be positioned at any suitable subsurface location or suitable surface location (e.g., on a platform, on a surface vessel, etc.). In addition, in certain embodiments, the components of the wellhead control system may be positioned at different locations. For example, the electrical power system and the fluid power unit may be positioned at a surface location (e.g., on a platform, on a surface vessel, etc.), and the wellhead electronic controller may be positioned above the BOP on the wellhead system.

The distributed control system 46 also includes multiple control sections distributed along a length 62 of the landing string 50. As used herein, "length of the landing string" (e.g., or other well string) refers to the extent of the landing string (e.g., or other well string) along a path extending from the wellhead system to the mineral deposit. In the illustrated embodiment, the distributed control system 46 includes a first control section 64, a second control section 66, and a third control section 68. As discussed in detail below, each control section is positioned at a different location along the length 62 of the landing string 50, and each control section is configured to control one or more devices of the landing string 50 that are positioned at the location of the respective control section. While the distributed control system 46 includes three control sections in the illustrated embodiment, in other embodiments, the distributed control system may include more or fewer control sections (e.g., 2, 4, 5, 6, or more), and each control section may be configured to control respective device(s) of the landing string.

As illustrated, the first control section 64, including each component of the first control section 64, is positioned at a first location 70 along the length 62 of the landing string 50. In the illustrated embodiment, the first control section 64 includes a first control section electronic controller 72 communicatively coupled to the wellhead electronic controller 52. The first control section electronic controller 72 is configured to receive the device control signal(s) output by the wellhead electronic controller 52, and the first control section electronic controller 72 is configured to output one or more respective control signals based on the device control signal(s), thereby controlling operation of respective landing string device(s) positioned at the first location 70. In certain embodiments, the first control section electronic controller 72 includes electrical circuitry configured to control one or more devices positioned at the first location 70. In the illustrated embodiment, the first control section electronic controller 72 includes a processor 74, such as a microprocessor, and a memory device 76. The first control section electronic controller 72 may also include one or more storage devices and/or other suitable component(s). The processor 74 may be used to execute software, such as software for controlling one or more devices positioned at the first location 70. Moreover, the processor 74 may include multiple microprocessors, one or more "general-purpose" microprocessors, one or more special-purpose microprocessors, and/or one or more application specific integrated circuits (ASICS), or some combination thereof. For example, the processor 74 may include one or more reduced instruction set (RISC) processors.

The memory device 76 may include a volatile memory, such as random access memory (RAM), and/or a nonvolatile memory, such as read-only memory (ROM). The memory device 76 may store a variety of information and may be used for various purposes. For example, the memory device 76 may store processor-executable instructions (e.g., firmware or software) for the processor 74 to execute, such as instructions for controlling one or more devices positioned at the first location 70. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling one or more devices positioned at the first location 70, etc.), and any other suitable data.

In the illustrated embodiment, the first control section 64 includes two control modules. The first control module 78 is configured to control a first device 80 of the landing string 50, and the second control module 82 is configured to control a second device 84 of the landing string 50. As illustrated, the first device 80 and the second device 84 are positioned at the first location 70 along the length 62 of the landing string 50. In addition, the first control module 78 and the second control module 82 are communicatively coupled to the first control section electronic controller 72. The first control section electronic controller 72 is configured to output a first control signal based on the device control signal(s) output by the wellhead electronic controller 52. The first control module 78 includes a first electric actuator configured to receive the first control signal and to control the first device 80 based on the first control signal. As discussed in detail below, the first electric actuator is configured to control the first device 80 by controlling flow of fluid through the first control module 78 to the first device 80 based on the first control signal. In addition, the first control section electronic controller 72 is configured to output a second control signal based on the device control signal(s) output by the wellhead electronic controller 52. The second control module 82 includes a second electric actuator configured to receive the second control signal and to control the second device 84 based on the second control signal. As discussed in detail below, the second electric actuator is configured to control the second device 84 by controlling flow of fluid through the second control module 82 to the second device 84 based on the second control signal.

In the illustrated embodiment, the first control section electronic controller 72 is electrically coupled to the electrical power system 58, and the first control section electronic controller 72 is configured to receive electrical power from the electrical power system 58. Furthermore, in certain embodiments, at least one control module of the first control section may receive electrical power from the electrical power system. Furthermore, in the illustrated embodiment, the first control module 78 and the second control module 82 are fluidly coupled to the fluid power unit 60, and the first and second control modules are configured to receive fluid (e.g., pressurized fluid) from the fluid power unit 60. Each control module is configured to control flow of the fluid to the respective landing string device, thereby controlling operation of the respective device. In the illustrated embodiment, the first control section 64 includes a first accumulator 86 fluidly coupled to a fluid supply line 88 that supplies the fluid to the first and second control modules. The first accumulator 86 is configured to establish a local supply of fluid, thereby substantially reducing the response time associated with controlling the devices at the first location 70 (e.g., as compared to a configuration in which fluid flows from the fluid power unit directly to the control modules). While the first control section includes a single accumulator in the illustrated embodiment, in other embodiments, the first control section may include more or fewer accumulators (e.g., 0, 2, 3, 4, or more). For example, in certain embodiments, the accumulator may be omitted.

Each device of the landing string 50 may include any suitable component configured to control operation of the mineral extraction system. For example, in certain embodiments, at least one device may include a valve, and the valve may be actuated by flow of fluid from the respective control module to the device. Furthermore, in certain embodiments, at least one device may include a locking mechanism (e.g., configured to secure the landing string within the wellhead, etc.), and the locking mechanism may be actuated by flow of fluid from the respective control module to the device. In addition, in certain embodiments, at least one device may include an actuator, and the actuator may be actuated by flow of fluid from the respective control module to the device.

By way of example, the first device 80 may include a valve, and the second device 84 may include a locking mechanism. The wellhead electronic controller 52 may output device control signals indicative of instructions to control the valve and the locking mechanism. The first control section electronic controller 72 may receive the device control signals, output a first control signal based on the device control signals, and output a second control signal based on the device control signals. The first control signal may be indicative of instructions to control the valve, and the second control signal may be indicative of instructions to control the locking mechanism. The first electric actuator of the first control module 78 may control flow of the fluid to the first device 80 based on the first control signal, thereby controlling the valve, and the second electric actuator of the second control module 82 may control flow of the fluid to the second device 84 based on the second control signal, thereby controlling the locking mechanism.

While the first control section 64 includes the first control section electronic controller 72 in the illustrated embodiment, in other embodiments, the first control section electronic controller may be omitted. In such embodiments, the wellhead electronic controller may output the respective control signal(s) to the respective control module(s) of the first control section. In addition, in certain embodiments, the first control section electronic controller may output respective control signal(s) to certain control module(s), and the wellhead electronic controller may output respective control signal(s) to other control module(s). Furthermore, in the illustrated embodiment, the first control section 64 includes two control modules configured to control two respective devices. However, in other embodiments, the first control section may include more or fewer control modules (e.g., 1, 3, 4, 5, 6, or more), and/or at least one control module may be configured to control multiple devices (e.g., devices fluidly coupled to one another in a serial flow arrangement, etc.). In addition, while each control module is configured to control a device positioned at the first location in the illustrated embodiment, in other embodiments, at least one control module may be configured to control a device positioned remote from the first location (e.g., alone or in combination with a device positioned at the first location). Furthermore, in certain embodiments, each component of the first control section may be disposed within a first control section housing. In other embodiments, at least one component of the first control section may be disposed within a housing of at least one device (e.g., each component of the first section may be disposed within the housing of one device, etc.), and/or at least one component of the first control section may not be disposed within a housing (e.g., each component of the first control section may not be disposed within a housing, etc.).

As illustrated, the second control section 66, including each component of the second control section 66, is positioned at a second location 90 along the length 62 of the landing string 50. In the illustrated embodiment, the second control section 66 includes a second control section electronic controller 92 communicatively coupled to the wellhead electronic controller 52. The second control section electronic controller 92 is configured to receive the device control signal(s) output by the wellhead electronic controller 52, and the second control section electronic controller 92 is configured to output one or more respective control signals based on the device control signal(s), thereby controlling operation of respective landing string device(s) positioned at the second location 90. In certain embodiments, the second control section electronic controller 92 includes electrical circuitry configured to control one or more devices positioned at the second location 90. In the illustrated embodiment, the second control section electronic controller 92 includes a processor 94, such as a microprocessor, and a memory device 96. The second control section electronic controller 92 may also include one or more storage devices and/or other suitable component(s). The processor 94 may be used to execute software, such as software for controlling one or more devices positioned at the second location 90. Moreover, the processor 94 may include multiple microprocessors, one or more "general-purpose" microprocessors, one or more special-purpose microprocessors, and/or one or more application specific integrated circuits (ASICS), or some combination thereof. For example, the processor 94 may include one or more reduced instruction set (RISC) processors.

The memory device 96 may include a volatile memory, such as random access memory (RAM), and/or a nonvolatile memory, such as read-only memory (ROM). The memory device 96 may store a variety of information and may be used for various purposes. For example, the memory device 96 may store processor-executable instructions (e.g., firmware or software) for the processor 94 to execute, such as instructions for controlling one or more devices positioned at the second location 90. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling one or more devices positioned at the second location 90, etc.), and any other suitable data.

In the illustrated embodiment, the second control section 66 includes two control modules. The first control module 98 is configured to control a first device 100 of the landing string 50, and the second control module 102 is configured to control a second device 104 of the landing string 50. As illustrated, the first device 100 and the second device 104 are positioned at the second location 90 along the length 62 of the landing string 50. In addition, the first control module 98 and the second control module 102 are communicatively coupled to the second control section electronic controller 92. The second control section electronic controller 92 is configured to output a first control signal based on the device control signal(s) output by the wellhead electronic controller 52. The first control module 98 includes a first electric actuator configured to receive the first control signal and to control the first device 100 based on the first control signal. As discussed in detail below, the first electric actuator is configured to control the first device 100 by controlling flow of fluid through the first control module 98 to the first device 100 based on the first control signal. In addition, the second control section electronic controller 92 is configured to output a second control signal based on the device control signal(s) output by the wellhead electronic controller 52. The second control module 102 includes a second electric actuator configured to receive the second control signal and to control the second device 104 based on the second control signal. As discussed in detail below, the second electric actuator is configured to control the second device 104 by controlling flow of fluid through the second control module 102 to the second device 104 based on the second control signal.

In the illustrated embodiment, the second control section electronic controller 92 is electrically coupled to the electrical power system 58, and the second control section electronic controller 92 is configured to receive electrical power from the electrical power system 58. Furthermore, in certain embodiments, at least one control module of the second control section may receive electrical power from the electrical power system. Furthermore, in the illustrated embodiment, the first control module 98 and the second control module 102 are fluidly coupled to the fluid power unit 60, and the first and second control modules are configured to receive fluid (e.g., pressurized fluid) from the fluid power unit 60. Each control module is configured to control flow of the fluid to the respective landing string device, thereby controlling operation of the respective device. In the illustrated embodiment, the second control section 66 includes a second accumulator 106 fluidly coupled to a fluid supply line 108 that supplies the fluid to the first and second control modules. The second accumulator 106 is configured to establish a local supply of fluid, thereby substantially reducing the response time associated with controlling the devices at the second location 90 (e.g., as compared to a configuration in which fluid flows from the fluid power unit directly to the control modules). While the second control section includes a single accumulator in the illustrated embodiment, in other embodiments, the second control section may include more or fewer accumulators (e.g., 0, 2, 3, 4, or more). For example, in certain embodiments, the accumulator may be omitted.

As previously discussed, each device of the landing string 50 may include any suitable component configured to control operation of the mineral extraction system. For example, in certain embodiments, at least one device may include a valve (e.g., subsea test well control valve, flow control valve, retainer valve, etc.), and the valve may be actuated by flow of fluid from the respective control module to the device. Furthermore, in certain embodiments, at least one device may include a locking mechanism (e.g., configured to secure the landing string within the wellhead, etc.), and the locking mechanism may be actuated by flow of fluid from the respective control module to the device. In addition, in certain embodiments, at least one device may include an actuator, and the actuator may be actuated by flow of fluid from the respective control module to the device.

By way of example, the first device 100 may include a first valve, and the second device 104 may include a second valve. The wellhead electronic controller 52 may output device control signals indicative of instructions to control the first and second valves. The second control section electronic controller 92 may receive the device control signals, output a first control signal based on the device control signals, and output a second control signal based on the device control signals. The first control signal may be indicative of instructions to control the first valve, and the second control signal may be indicative of instructions to control the second valve. The first electric actuator of the first control module 98 may control flow of the fluid to the first device 100 based on the first control signal, thereby controlling the first valve, and the second electric actuator of the second control module 102 may control flow of the fluid to the second device 104 based on the second control signal, thereby controlling the second valve.

While the second control section 66 includes the second control section electronic controller 92 in the illustrated embodiment, in other embodiments, the second control section electronic controller may be omitted. In such embodiments, the wellhead electronic controller may output the respective control signal(s) to the respective control module(s) of the second control section. In addition, in certain embodiments, the second control section electronic controller may output respective control signal(s) to certain control module(s), and the wellhead electronic controller may output respective control signal(s) to other control module(s). Furthermore, in the illustrated embodiment, the second control section 66 includes two control modules configured to control two respective devices. However, in other embodiments, the second control section may include more or fewer control modules (e.g., 1, 3, 4, 5, 6, or more), and/or at least one control module may be configured to control multiple devices (e.g., devices fluidly coupled to one another in a serial flow arrangement, etc.). In addition, while each control module is configured to control a device positioned at the second location in the illustrated embodiment, in other embodiments, at least one control module may be configured to control a device positioned remote from the second location (e.g., alone or in combination with a device positioned at the second location). Furthermore, in certain embodiments, each component of the second control section may be disposed within a second control section housing. In other embodiments, at least one component of the second control section may be disposed within a housing of at least one device (e.g., each component of the second section may be disposed within the housing of one device, etc.), and/or at least one component of the second control section may not be disposed within a housing (e.g., each component of the second control section may not be disposed within a housing, etc.).

As illustrated, the third control section 68, including each component of the third control section 68, is positioned at a third location 110 along the length 62 of the landing string 50. In the illustrated embodiment, the third control section 68 includes a third control section electronic controller 112 communicatively coupled to the wellhead electronic controller 52. The third control section electronic controller 112 is configured to receive the device control signal(s) output by the wellhead electronic controller 52, and the third control section electronic controller 112 is configured to output one or more respective control signals based on the device control signal(s), thereby controlling operation of respective landing string device(s) positioned at the third location 110. In certain embodiments, the third control section electronic controller 112 includes electrical circuitry configured to control one or more devices positioned at the third location 110. In the illustrated embodiment, the third control section electronic controller 112 includes a processor 114, such as a microprocessor, and a memory device 116. The third control section electronic controller 112 may also include one or more storage devices and/or other suitable component(s). The processor 114 may be used to execute software, such as software for controlling one or more devices positioned at the third location 110. Moreover, the processor 114 may include multiple microprocessors, one or more "general-purpose" microprocessors, one or more special-purpose microprocessors, and/or one or more application specific integrated circuits (ASICS), or some combination thereof. For example, the processor 114 may include one or more reduced instruction set (RISC) processors.

The memory device 116 may include a volatile memory, such as random access memory (RAM), and/or a nonvolatile memory, such as read-only memory (ROM). The memory device 116 may store a variety of information and may be used for various purposes. For example, the memory device 116 may store processor-executable instructions (e.g., firmware or software) for the processor 114 to execute, such as instructions for controlling one or more devices positioned at the third location 110. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for controlling one or more devices positioned at the third location 110, etc.), and any other suitable data.

In the illustrated embodiment, the third control section 68 includes two control modules. The first control module 118 is configured to control a first device 120 of the landing string 50, and the second control module 122 is configured to control a second device 124 of the landing string 50. As illustrated, the first device 120 and the second device 124 are positioned at the third location 110 along the length 62 of the landing string 50. In addition, the first control module 118 and the second control module 122 are communicatively coupled to the third control section electronic controller 112. The third control section electronic controller 112 is configured to output a first control signal based on the device control signal(s) output by the wellhead electronic controller 52. The first control module 118 includes a first electric actuator configured to receive the first control signal and to control the first device 120 based on the first control signal. As discussed in detail below, the first electric actuator is configured to control the first device 120 by controlling flow of fluid through the first control module 118 to the first device 120 based on the first control signal. In addition, the third control section electronic controller 112 is configured to output a second control signal based on the device control signal(s) output by the wellhead electronic controller 52. The second control module 122 includes a second electric actuator configured to receive the second control signal and to control the second device 124 based on the second control signal. As discussed in detail below, the second electric actuator is configured to control the second device 124 by controlling flow of fluid through the second control module 122 to the second device 124 based on the second control signal.

In the illustrated embodiment, the third control section electronic controller 112 is electrically coupled to the electrical power system 58, and the third control section electronic controller 112 is configured to receive electrical power from the electrical power system 58. Furthermore, in certain embodiments, at least one control module of the third control section may receive electrical power from the electrical power system. Furthermore, in the illustrated embodiment, the first control module 118 and the second control module 122 are fluidly coupled to the fluid power unit 60, and the first and second control modules are configured to receive fluid (e.g., pressurized fluid) from the fluid power unit 60. Each control module is configured to control flow of the fluid to the respective landing string device, thereby controlling operation of the respective device. In the illustrated embodiment, the third control section 68 includes a third accumulator 125 fluidly coupled to a fluid supply line 126 that supplies the fluid to the first and second control modules. The third accumulator 125 is configured to establish a local supply of fluid, thereby substantially reducing the response time associated with controlling the devices at the third location 110 (e.g., as compared to a configuration in which fluid flows from the fluid power unit directly to the control modules). While the third control section includes a single accumulator in the illustrated embodiment, in other embodiments, the third control section may include more or fewer accumulators (e.g., 0, 2, 3, 4, or more). For example, in certain embodiments, the accumulator may be omitted.

As previously discussed, each device of the landing string 50 may include any suitable component configured to control operation of the mineral extraction system. For example, in certain embodiments, at least one device may include a valve, and the valve may be actuated by flow of fluid from the respective control module to the device. Furthermore, in certain embodiments, at least one device may include a locking mechanism (e.g., configured to secure the landing string within the wellhead, etc.), and the locking mechanism may be actuated by flow of fluid from the respective control module to the device. In addition, in certain embodiments, at least one device may include an actuator, and the actuator may be actuated by flow of fluid from the respective control module to the device.

By way of example, the first device 120 may include a first valve, and the second device 124 may include a second valve. The wellhead electronic controller 52 may output device control signals indicative of instructions to control the first and second valves. The third control section electronic controller 112 may receive the device control signals, output a first control signal based on the device control signals, and output a second control signal based on the device control signals. The first control signal may be indicative of instructions to control the first valve, and the second control signal may be indicative of instructions to control the second valve. The first electric actuator of the first control module 118 may control flow of the fluid to the first device 120 based on the first control signal, thereby controlling the first valve, and the second electric actuator of the second control module 122 may control flow of the fluid to the second device 124 based on the second control signal, thereby controlling the second valve.

While the third control section 68 includes the third control section electronic controller 112 in the illustrated embodiment, in other embodiments, the third control section electronic controller may be omitted. In such embodiments, the wellhead electronic controller may output the respective control signal(s) to the respective control module(s) of the third control section. In addition, in certain embodiments, the third control section electronic controller may output respective control signal(s) to certain control module(s), and the wellhead electronic controller may output respective control signal(s) to other control module(s). Furthermore, in the illustrated embodiment, the third control section 68 includes two control modules configured to control two respective devices. However, in other embodiments, the third control section may include more or fewer control modules (e.g., 1, 3, 4, 5, 6, or more), and/or at least one control module may be configured to control multiple devices (e.g., devices fluidly coupled to one another in a serial flow arrangement, etc.). In addition, while each control module is configured to control a device positioned at the third location in the illustrated embodiment, in other embodiments, at least one control module may be configured to control a device positioned remote from the third location (e.g., alone or in combination with a device positioned at the third location). Furthermore, in certain embodiments, each component of the third control section may be disposed within a third control section housing. In other embodiments, at least one component of the third control section may be disposed within a housing of at least one device (e.g., each component of the third control section may be disposed within the housing of one device, etc.), and/or at least one component of the third control section may not be disposed within a housing (e.g., each component of the third control section may not be disposed within a housing, etc.).

As used herein, "location" along the length 62 of the landing string 50 (e.g., or other well string) refers to a portion of the extent of the landing string (e.g., or other well string) along a path extending from the wellhead system to the mineral deposit. For example, the portion may be represented as a percentage of the length of the landing string (e.g., 2 percent, 1 percent, 0.5 percent, 0.25 percent, etc.). The locations are non-overlapping, and the locations may be separated by any suitable distance. For example, adjacent locations may be separated by a distance of at least a percentage of the length of the landing string (e.g., 1 percent, 10 percent, 25 percent, 50 percent, 75 percent, etc.).

In certain embodiments, at least one control section may include one or more monitoring device(s) communicatively coupled to the respective control section electronic controller and/or to the wellhead electronic controller. For example, in certain embodiments, at least one control module may include one or more monitoring device(s), and each monitoring device may include one or more fluid pressure sensors configured to output respective sensor signal(s) indicative of fluid pressure(s) (e.g., within conduit(s) of the control module, within a conduit extending between the control module and the respective device, etc.). In certain embodiments, the respective control section electronic controller and/or the wellhead electronic controller may be configured to determine the state of the respective device(s) (e.g., open/closed state of a valve, locked/unlocked state of a locking mechanism, etc.) based on the sensor signal(s). While pressure sensors are disclosed above, at least one monitoring device may include other suitable type(s) of sensor(s) (e.g., alone or in combination with the pressure sensor(s)), such as optical sensor(s), temperature sensor(s), position sensor(s) (e.g., for determining state(s) of respective actuator(s)/locking mechanism(s), etc.), other suitable type(s) of sensor(s), or a combination thereof.

Because the control modules are positioned at the same location along the length of the landing string as the respective devices, the response time associated with controlling the devices may be substantially reduced (e.g., as compared to a control system having control modules positioned above a BOP of the mineral extraction system). Furthermore, in certain embodiments, a control module may be included for each respective device of the landing string. Accordingly, the distributed control system may not include any extraneous control modules, thereby decreasing the cost of the mineral extraction system (e.g., as compared to a mineral extraction system having a control system configured to accommodate landing string configurations having a larger number of devices). For example, the number of control sections and the number of control modules within each control section may be selectable, thereby establishing a modular mineral extraction system. Furthermore, in certain embodiments, a complete landing string including the devices and the distributed control system may be formed before the landing string is run, thereby reducing rigging time.

In the illustrated embodiment, a single fluid conduit 127 extends from the fluid power unit 60, and fluid connectors extend from the fluid conduit 127 to the respective control sections (e.g., in which each fluid connector is positioned at the location of the respective control section). In addition, a single electrical line 128 (e.g., electrical conductor) extends from the electrical power system 58, and electrical connectors extend from the electrical line 128 to the respective control sections (e.g., in which each electrical connector is positioned at the location of the respective control section). Utilizing the single fluid conduit 127 and the single electrical line 128 may significantly reduce the cost of the mineral extraction system (e.g., as compared to a mineral extraction system including individual fluid conduits extending from the fluid power unit to the respective control sections and/or individual electrical lines extending from the electrical power system to the respective control sections). By way of example, for subsea applications in which the electrical power system and the fluid power unit are positioned on a platform or surface vessel, the umbilical extending between the platform/surface vessel and the wellhead may only include a single fluid conduit and a single electrical line for the control sections, thereby substantially reducing the cost of the umbilical (e.g., as compared to an umbilical having individual fluid conduits for the respective control sections and/or individual electrical lines for the respective control sections). While a single fluid conduit 127 extends from the fluid power unit 60 in the illustrated embodiment, in other embodiments, multiple fluid conduits may extend from the fluid power unit (e.g., one fluid conduit for each control section). Furthermore, while a single electrical line 128 extends from the electrical power system 58 in the illustrated embodiment, in other embodiments, multiple electrical lines may extend from the electrical power system (e.g., one electrical line for each control section).

Figure 3:
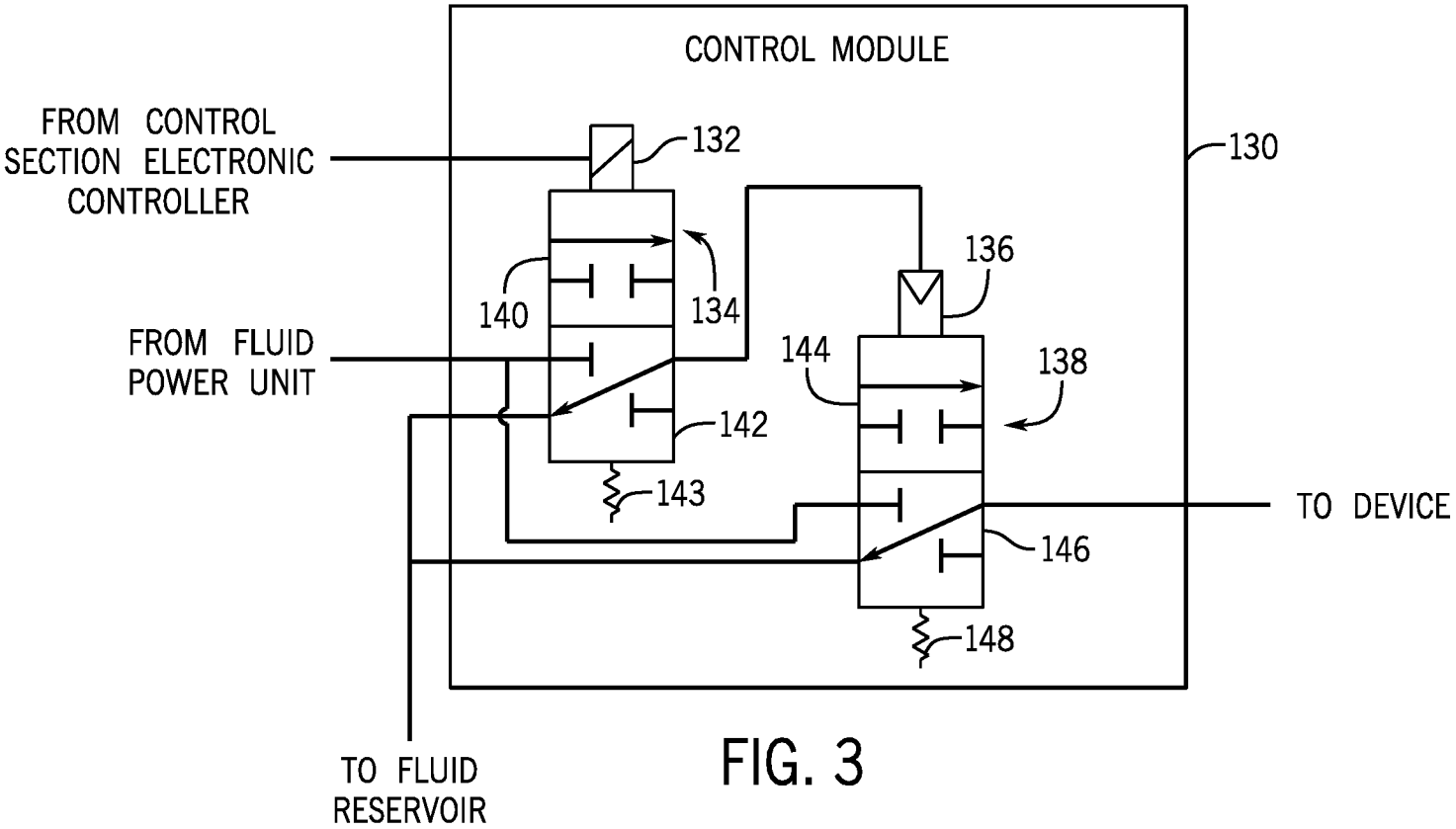
FIG. 3 is a block diagram of an embodiment of a control module that may be employed within a control section of the distributed control system of FIG. 2.

FIG. 3 is a block diagram of an embodiment of a control module 130 that may be employed within a control section of the distributed control system of FIG. 2. For example, the control module 130 may correspond to the first control module of the first control section, the second control module of the first control section, the first control module of the second control section, the second control module of the second control section, the first control module of the third control section, the second control module of the third control section, another suitable control module of a control section (e.g., the first control section, the second control section, the third control section, or another suitable control section), or a combination thereof. As previously discussed with regard to the control modules disclosed above, the control module 130 includes an electric actuator 132 configured to receive a respective control signal (e.g., first control signal, second control signal, etc.) and to control the respective device based on the respective control signal. The electric actuator 132 is configured to control the respective device by controlling flow of fluid through the control module 130 to the respective device based on the respective control signal.

In the illustrated embodiment, the control module 130 includes an electrically actuated valve 134 coupled to the electric actuator 132. In addition, the control module 130 includes a fluid actuator 136 fluidly coupled to the electrically actuated valve 134. The control module 130 also includes a fluidly actuated valve 138 coupled to the fluid actuator 136. The electric actuator 132 is configured to control a position of the electrically actuated valve 134 based on the respective control signal, and the electrically actuated valve 134 is configured to control flow of the fluid from the fluid power unit to the fluid actuator 136 based on the position of the electrically actuated valve 134. In the illustrated embodiment, the electrically actuated valve 134 is a two-position valve having a first position 140 and a second position 142. While the electrically actuated valve 134 is in the first position 140, the fluid flows from the fluid power unit to the fluid actuator 136, and while the electrically actuated valve 134 is in the second position 142, the fluid flows from the fluid actuator 136 to a fluid reservoir.

Furthermore, the fluid actuator 136 is configured to control a position of the fluidly actuated valve 138 based on reception of the fluid, and the fluidly actuated valve 138 is configured to control flow of the fluid from the fluid power unit to the respective device based on the position of the fluidly actuated valve 138. In the illustrated embodiment, the fluidly actuated valve 138 is a two-position valve having a first position 144 and a second position 146. While the fluidly actuated valve 138 is in the first position 144, the fluid flows from the fluid power unit to the respective device, and while the fluidly actuated valve 138 is in the second position 146, the fluid flows from the respective device to the fluid reservoir. Accordingly, the control module is configured to control fluid flow to the respective device based on the respective control signal. While receiving fluid from the fluid power unit is disclosed herein, in certain embodiments, the fluid may be received from the fluid power unit via the respective accumulator, as previously discussed. Accordingly, the electrically actuated valve 134 and the fluidly actuated valve 138 may be fluidly coupled to the accumulator.

By way of example, in embodiments in which the device includes a valve, the valve may be biased to a closed position. Accordingly, the valve may be in the closed position while fluid is not provided to the device, and fluid flow to the device may drive the valve to an open position. To transition the valve to the open position, the respective control section electronic controller may output a respective control signal indicative of opening the valve. The electric actuator 132 may drive the electrically actuated valve 134 from the second position 142 to the first position 140 in response to receiving the respective control signal. With the electrically actuated valve 134 in the first position 140, the fluid flows from the fluid power unit to the fluid actuator 136. In response to receiving the fluid, the fluid actuator 136 drives the fluidly actuated valve 138 from the second position 146 to the first position 144. With the fluidly actuated valve 138 in the first position 144, the fluid flows from the fluid power unit to the device, thereby driving the valve to the open position. In addition, to transition the valve to the closed position, the respective control section electronic controller may output a respective control signal indicative of closing the valve, or the respective control section electronic controller may terminate output of the respective control signal (e.g., the respective control signal indicative of opening the valve). In response, the electric actuator 132 may enable the electrically actuated valve 134 to move from the first position 140 to the second position 142. In the illustrated embodiment, a biasing device 143 (e.g., spring, pneumatic cylinder, etc.) drives the electrically actuated valve 134 to move from the first position 140 to the second position 142 in response to deactivation of the electric actuator 132. With the electrically actuated valve 134 in the second position 142, the fluid flows from the fluid actuator 136 to a fluid reservoir (e.g., drain). Accordingly, the fluid actuator 136 may enable the fluidly actuated valve 138 to move from the first position 144 to the second position 146. In the illustrated embodiment, a biasing device 148 (e.g., spring, pneumatic cylinder, etc.) drives the fluidly actuated valve 138 from the first position 144 to the second position 146 in response to reduced fluid pressure within/termination of fluid flow to the fluid actuator 136. With the fluidly actuated valve 138 in the second position 146, the fluid flows from the device to the fluid reservoir, thereby enabling the valve to return to the closed position.

While controlling a biased-closed valve is disclosed above, the control module 130 may be used to control a biased-open valve (e.g., a valve that is biased to an open position), a locking mechanism, an actuator, or any other suitable component configured to control operation of the mineral extraction system. Furthermore, while the electrically actuated valve 134 and the fluidly actuated valve 138 are biased toward the respective second positions in the illustrated embodiment, in certain embodiments, at least one of the valves may be biased toward the first position. In addition, while the electrically actuated valve 134 is controlled by a single electric actuator 132 in the illustrated embodiment, in other embodiments, the electrically actuated valve may be controlled by a first electric actuator configured to drive the electrically actuated valve to the first position and a second electric actuator configured to drive the electrically actuated valve to the second position (e.g., the electrically actuated valve biasing device may be omitted). Furthermore, while the fluidly actuated valve 138 is controlled by a single fluid actuator 136 in the illustrated embodiment, in other embodiments, the fluidly actuated valve may be controlled by a first fluid actuator configured to drive the fluidly actuated valve to the first position and a second fluid actuator configured to drive the fluidly actuated valve to the second position (e.g., the fluidly actuated valve biasing device may be omitted).

In the illustrated embodiment, each of the electrically actuated valve and the fluidly actuated valve is configured to be in either the first position or the second position (e.g., on/off valve). However, in certain embodiments, the electrically actuated valve may be a control valve (e.g., proportional control valve) configured to control a flow rate of the fluid through the valve. In such embodiments, the electric actuator(s) may be configured to control a position of the respective valve, thereby controlling the flow rate of the fluid to the fluid actuator(s). Furthermore, in embodiments in which the electrically actuated valve is a control valve, the fluidly actuated valve may also be a control valve (e.g., proportional control valve) configured to control a flow rate of the fluid through the valve. Accordingly, the control module may control a flow rate of the fluid to the respective device.

In addition, while the control module 130 is configured to control flow of the fluid to the respective device in the illustrated embodiment, in other embodiments, the control module may be configured to control flow of the fluid from the device, or the control module may be configured to control flow of the fluid to the device and from the device. Furthermore, the electrical actuator 132 may include any suitable type(s) of electric actuator(s), such as solenoid(s), linear actuator(s), rotary actuator(s), other suitable type(s) of electric actuator(s), or a combination thereof. While the control module includes two valves in the illustrated embodiment, in other embodiments, the control module may include more or fewer valves. For example, in certain embodiments, the fluidly actuated valve may be omitted, and the electrically actuated valve may directly control the flow of fluid to the respective device. Furthermore, in certain embodiments, the control module may include a first set of one or more valves configured to control flow of the fluid to the respective device and a second set of one or more valves configured to control flow of the fluid from the respective device. In each valve configuration, the control module includes at least one electric actuator configured to receive a respective control signal and to control flow of the fluid to the respective device based on the respective control signal, thereby controlling the respective device.

While the distributed control system is disclosed herein with reference to a landing string, the distributed control system may be utilized with any other suitable well string, such as a completion string. For example, the distributed control system may be utilized to control completion devices disposed along a length of a completion string. As used herein, "well string" refers to a string that extends into and/or within a wellbore, including a landing string and a completion string. Furthermore, while utilizing the distributed control system to control devices of the landing string (e.g., well string) is disclosed above, in certain embodiments, the distributed control system may also be used to control one or more devices positioned remote from the landing string (e.g., well string). For example, in certain embodiments, the distributed control system may include a control section positioned at the location of a component of the wellhead system, such as the BOP or a test tree (e.g., subsea test tree). The control section may include one or more control modules, and each control module may include an electric actuator configured to control flow of fluid to a respective device (e.g., valve, locking mechanism, etc.) of the component or another component based on a respective control signal, thereby controlling the device.

Technical effects of the disclosure include decreasing the response time associated with controlling devices of the landing string. Because the control modules are positioned at the same location along the length of the landing string as the respective devices, the response time associated with controlling the devices may be substantially reduced (e.g., as compared to a control system having control modules positioned above a BOP of the mineral extraction system). Furthermore, a control module may be included for each respective device of the landing string. Accordingly, the distributed control system may not include any extraneous control modules, thereby decreasing the cost of the mineral extraction system (e.g., as compared to a mineral extraction system having a control system configured to accommodate landing string configurations having a larger number of devices).

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A distributed control system for a well string, comprising:

a first control section configured to be positioned at a first location along a length of the well string, wherein the first control section comprises a first control module configured to control a first device positioned at the first location along the length of the well string, the first control module comprises a first electric actuator configured to receive a first control signal, and the first electric actuator is configured to control flow of a fluid to the first device based on the first control signal to control the first device; and a second control section configured to be positioned at a second location along the length of the well string, remote from the first location, wherein the second control section comprises a second control module configured to control a second device positioned at the second location along the length of the well string, the second control module comprises a second electric actuator configured to receive a second control signal, and the second electric actuator is configured to control flow of the fluid to the second device based on the second control signal to control the second device wherein the first control module further comprises:

an electrically actuated valve coupled to the first electric actuator;

a fluid actuator fluidly coupled to the electrically actuated valve; and a fluidly actuated valve coupled to the fluid actuator;

wherein the first electric actuator is configured to control a position of the electrically actuated valve based on the first control signal, the electrically actuated valve is configured to control flow of the fluid to the fluid actuator based on the position of the electrically actuated valve, the fluid actuator is configured to control a position of the fluidly actuated valve based on reception of the fluid, and the fluidly actuated valve is configured to control flow of the fluid to the first device based on the position of the fluidly actuated valve.

2. The distributed control system of claim 1, further comprising a third control section configured to be positioned at a third location along the length of the well string, remote from the first and second locations, wherein the third control section comprises a third control module configured to control a third device positioned at a third location along the length of the well string, the third control module comprises a third electric actuator configured to receive a third control signal, and the third electric actuator is configured to control flow of the fluid to the third device based on the third control signal to control the third device.

3. The distributed control system of claim 1, wherein the first control section further comprises a fourth control module configured to control a fourth device positioned at the first location along the length of the well string, the fourth control module comprises a fourth electric actuator configured to receive a fourth control signal, and the fourth electric actuator is configured to control flow of the fluid to the fourth device based on the fourth control signal to control the fourth device.

4. The distributed control system of claim 3, wherein the second control section further comprises a fifth control module configured to control a fifth device positioned at the second location along the length of the well string, the fifth control module comprises a fifth electric actuator configured to receive a fifth control signal, and the fifth electric actuator is configured to control flow of the fluid to the fifth device based on the fifth control signal to control the fifth device.

5. The distributed control system of claim 1, wherein the first electric actuator comprises a solenoid, or the second electric actuator comprises a solenoid, or a combination thereof.

6. The distributed control system of claim 1, wherein the first control section further comprises an accumulator fluidly coupled to the electrically actuated valve and to the fluidly actuated valve.

7. The distributed control system of claim 1, wherein the first control section further comprises a first control section electronic controller communicatively coupled to the first electric actuator, or the second control section further comprises a second control section electronic controller communicatively coupled to the second electric actuator, or a combination thereof.

8. A distributed control system for a well string, comprising:

a wellhead control system comprising a wellhead electronic controller having a memory and a processor, wherein the wellhead electronic controller is configured to output one or more device control signals; and a plurality of control sections distributed along a length of the well string, comprising:

a first control section configured to be positioned at a first location along the length of the well string, wherein the first control section comprises:

a first control section electronic controller comprising a memory and a processor, wherein the first control section electronic controller is communicatively coupled to the wellhead electronic controller, the first control section electronic controller is configured to receive the one or more device control signals, and the first control section electronic controller is configured to output a first control signal based on the one or more device control signals; and a first control module configured to control a first device positioned at the first location along the length of the well string, wherein the first control module comprises a first electric actuator configured to receive the first control signal, and the first electric actuator is configured to control flow of a fluid to the first device based on the first control signal to control the first device; and a second control section configured to be positioned at a second location along the length of the well string, remote from the first location, wherein the second control section comprises:

a second control section electronic controller comprising a memory and a processor, wherein the second control section electronic controller is communicatively coupled to the wellhead electronic controller, the second control section electronic controller is configured to receive the one or more device control signals, and the second control section electronic controller is configured to output a second control signal based on the one or more device control signals; and a second control module configured to control a second device positioned at the second location along the length of the well string, wherein the second control module comprises a second electric actuator configured to receive the second control signal, and the second electric actuator is configured to control flow of the fluid to the second device based on the second control signal to control the second device wherein the wellhead control system further comprises a fluid power unit configured to output the fluid, and the first control module further comprises:

an electrically actuated valve coupled to the first electric actuator;

a fluid actuator fluidly coupled to the electrically actuated valve; and a fluidly actuated valve coupled to the fluid actuator;

wherein the first electric actuator is configured to control a position of the electrically actuated valve based on the first control signal, the electrically actuated valve is configured to control flow of the fluid to the fluid actuator based on the position of the electrically actuated valve, the fluid actuator is configured to control a position of the fluidly actuated valve based on reception of the fluid, and the fluidly actuated valve is configured to control flow of the fluid to the first device based on the position of the fluidly actuated valve.

9. The distributed control system of claim 8, wherein the wellhead control system further comprises an electrical power system configured to output electrical power, the first control section electronic controller is configured to receive the electrical power from the electrical power system, and the second control section electronic controller is configured to receive the electrical power from the electrical power system.

10. The distributed control system of claim 8, wherein the first control section further comprises an accumulator fluidly coupled to the electrically actuated valve and to the fluidly actuated valve.

11. The distributed control system of claim 8, wherein the plurality of control sections further comprises a third control section configured to be positioned at a third location along the length of the well string, remote from the first and second locations, wherein the third control section comprises:

a third control section electronic controller comprising a memory and a processor, wherein the third control section electronic controller is communicatively coupled to the wellhead electronic controller, the third control section electronic controller is configured to receive the one or more device control signals, and the third control section electronic controller is configured to output a third control signal based on the one or more device control signals; and a third control module configured to control a third device positioned at the third location along the length of the well string, wherein the third control module comprises a third electric actuator configured to receive the third control signal, and the third electric actuator is configured to control flow of the fluid to the third device based on the third control signal to control the third device.

12. The distributed control system of claim 8, wherein the first control section further comprises a fourth control module configured to control a fourth device positioned at the first location along the length of the well string, the first control section electronic controller is configured to output a fourth control signal based on the one or more device control signals, the fourth control module comprises a fourth electric actuator configured to receive the fourth control signal, and the fourth electric actuator is configured to control flow of the fluid to the fourth device based on the fourth control signal to control the fourth device.

13. The distributed control system of claim 12, wherein the second control section further comprises a fifth control module configured to control a fifth device positioned at the second location along the length of the well string, the second control section electronic controller is configured to output a fifth control signal based on the one or more device control signals, the fifth control module comprises a fifth electric actuator configured to receive the fifth control signal, and the fifth electric actuator is configured to control flow of the fluid to the fifth device based on the fifth control signal to control the fifth device.

14. A mineral extraction system, comprising:

a well string, comprising:

a first device positioned at a first location along a length of the well string; and a second device positioned at a second location along the length of the well string, remote from the first location; and a distributed control system, comprising:

a first control section positioned at the first location along the length of the well string, wherein the first control section comprises a first control module configured to control the first device, the first control module comprises a first electric actuator configured to receive a first control signal, and the first electric actuator is configured to control flow of a fluid to the first device based on the first control signal to control the first device; and a second control section positioned at the second location along the length of the well string, wherein the second control section comprises a second control module configured to control the second device, the second control module comprises a second electric actuator configured to receive a second control signal, and the second electric actuator is configured to control flow of the fluid to the second device based on the second control signal to control the second device wherein the first control module further comprises:

an electrically actuated valve coupled to the first electric actuator;

a fluid actuator fluidly coupled to the electrically actuated valve; and a fluidly actuated valve coupled to the fluid actuator;

wherein the first electric actuator is configured to control a position of the electrically actuated valve based on the first control signal, the electrically actuated valve is configured to control flow of the fluid to the fluid actuator based on the position of the electrically actuated valve, the fluid actuator is configured to control a position of the fluidly actuated valve based on reception of the fluid, and the fluidly actuated valve is configured to control flow of the fluid to the first device based on the position of the fluidly actuated valve.

15. The mineral extraction system of claim 14, wherein the well string further comprises a third device positioned at a third location along the length of the well string, remote from the first and second locations, the distributed control system further comprises a third control section positioned at the third location along the length of the well string, the third control section comprises a third control module configured to control the third device, the third control module comprises a third electric actuator configured to receive a third control signal, and the third electric actuator is configured to control flow of the fluid to the third device based on the third control signal to control the third device.

16. The mineral extraction system of claim 14, wherein the well string further comprises a fourth device positioned at the first location along the length of the well string, the first control section further comprises a fourth control module configured to control the fourth device, the fourth control module comprises a fourth electric actuator configured to receive a fourth control signal, and the fourth electric actuator is configured to control flow of the fluid to the fourth device based on the fourth control signal to control the fourth device.

17. The mineral extraction system of claim 14, wherein the first device comprises a first valve, or the second device comprises a second valve, or a combination thereof.

* * * * *